US006092758A

United States Patent [19]

Gemmell

[11] Patent Number: 6,092,758

[45] Date of Patent: Jul. 25, 2000

[54] ADAPTER AND DISPENSER FOR CORELESS ROLLS OF PRODUCTS

[75] Inventor: Bruce McLean Gemmell, Wilmington, Del.

[73] Assignee: Kimberly-Clark Worldwide, Inc., Neenah, Wis.

[21] Appl. No.: 09/137,693

[22] Filed: Aug. 21, 1998

Related U.S. Application Data

[60] Provisional application No. 60/058,131, Sep. 8, 1997.

[51] Int. Cl.[7] ..... B65H 16/06

[52] U.S. Cl. ..... 242/596.4; 242/596.7; 242/596.8

[58] Field of Search ..... 242/596, 596.4, 242/596.7, 596.8

[56] References Cited

U.S. PATENT DOCUMENTS

| | | | |
|---|---|---|---|
| Re. 25,828 | 8/1965 | Wooster . | |
| D. 238,462 | 1/1976 | Bauman | D6/97 |
| D. 238,466 | 1/1976 | Bauman | D6/97 |
| D. 316,201 | 4/1991 | Shimasaki | D6/518 |
| D. 318,770 | 8/1991 | Grisel | D6/523 |
| D. 327,798 | 7/1992 | Addison et al. | D6/523 |

(List continued on next page.)

FOREIGN PATENT DOCUMENTS

| | | |
|---|---|---|
| 2190806 | 6/1997 | Canada . |
| 0089933 A1 | 9/1983 | European Pat. Off. . |
| 0618159A2 | 2/1994 | European Pat. Off. . |
| 0842881A2 | 5/1998 | European Pat. Off. . |
| 2 251 202 | 6/1975 | France . |
| 1 248 002 | 9/1971 | United Kingdom . |
| 2 244 472A | 12/1992 | United Kingdom . |
| 2 276 107A | 9/1994 | United Kingdom . |
| 2 294 681 | 5/1996 | United Kingdom . |
| 93/10700 | 6/1993 | WIPO . |
| 94/27483 | 12/1994 | WIPO . |
| 95/01929 | 1/1995 | WIPO . |
| 95/08940 | 4/1995 | WIPO . |
| 95/13183 | 5/1995 | WIPO . |
| 96/27546 | 9/1996 | WIPO . |
| 96/28079 | 9/1996 | WIPO . |

OTHER PUBLICATIONS

JP 8196469 A (Abstract Only); Assignee: Sekisui Chem Ind Co. Ltd.; Aug. 1996.

JP 8333041 A (Abstract Only); Assignee: Taisei Tekkosho KK; Dec. 17, 1996.

JP 8333055 A (Abstract Only); Assignee: Uchinami KK; Dec. 17, 1996.

JP 9118455 A (Abstract Only); Assignee: Taisei Tekkosho KK; May 6, 1997.

JP 9216755 A (Abstrsct Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec. 11, 1996.

*Primary Examiner*—Donald P. Walsh
*Assistant Examiner*—William A. Rivera
*Attorney, Agent, or Firm*—Karl V. Sidor

[57] ABSTRACT

An adapter for converting a core roll product dispenser into a dispenser for a coreless roll product having a pair of depressions defined in the ends of the coreless roll. The adapter includes: (1) a housing defining a central cavity and an opening at an end of the central cavity; (2) a retractable plunger having a distal end, a central shaft, and a base, the retractable plunger being configured so the base and a first portion of the central shaft is retained in the housing and the distal end and a second portion of the central shaft extend through the opening at an end of the central cavity so the plunger is adapted to penetrate a depression defined at an end of a coreless roll product; (3) a resilient element in communication with the plunger that can apply a force against the plunger so the plunger is adapted to retract into the central cavity when a greater opposing force is applied against its distal end during loading and extend when the greater opposing force is removed; and (4) an element that may be used to secure the adapter to a core roll product dispenser. The adapters may be part of a dispenser for a coreless roll product having a pair of depressions defined in the ends of the coreless roll.

33 Claims, 7 Drawing Sheets

U.S. PATENT DOCUMENTS

| | | | |
|---|---|---|---|
| 390,084 | 9/1888 | Lane . | |
| 419,811 | 1/1890 | Zerr . | |
| 498,900 | 6/1893 | Hicks . | |
| 1,217,211 | 2/1917 | Pico . | |
| 1,229,431 | 6/1917 | Farrell . | |
| 1,778,282 | 10/1930 | Stewart . | |
| 2,049,964 | 8/1936 | Lawson . | |
| 2,232,968 | 2/1941 | Price et al. . | |
| 2,276,414 | 3/1942 | Morehouse et al. . | |
| 2,299,626 | 10/1942 | Hunt . | |
| 2,308,840 | 1/1943 | Vaughan et al. . | |
| 2,380,644 | 7/1945 | Grondona . | |
| 2,390,399 | 12/1945 | Tator et al. . | |
| 2,555,885 | 6/1951 | Hope | 242/596.8 |
| 2,566,883 | 9/1951 | Gove . | |
| 2,695,208 | 11/1954 | Graham . | |
| 2,726,823 | 12/1955 | Jespersen . | |
| 2,790,608 | 4/1957 | Sieven . | |
| 2,830,775 | 4/1958 | Kiesel . | |
| 2,839,346 | 6/1958 | Lawalin . | |
| 2,845,231 | 7/1958 | Grettve . | |
| 2,849,191 | 8/1958 | Gadler . | |
| 2,872,263 | 2/1959 | Andersson . | |
| 2,873,158 | 2/1959 | Pinkham . | |
| 2,905,404 | 9/1959 | Simmons . | |
| 2,939,645 | 6/1960 | Rowlands et al. . | |
| 2,946,636 | 7/1960 | Penney . | |
| 3,004,693 | 10/1961 | Johnson . | |
| 3,029,035 | 4/1962 | Layton . | |
| 3,032,283 | 5/1962 | Wooster . | |
| 3,038,598 | 6/1962 | Layton et al. | 206/58 |
| 3,045,939 | 7/1962 | Vander Waal . | |
| 3,084,006 | 4/1963 | Roemer . | |
| 3,333,909 | 8/1967 | Beker . | |
| 3,580,651 | 5/1971 | Gauper . | |
| 3,729,145 | 4/1973 | Koo et al. | 242/596.8 |
| 3,791,601 | 2/1974 | Broden . | |
| 3,794,253 | 2/1974 | Megdall . | |
| 3,799,467 | 3/1974 | Bauman . | |
| 3,802,639 | 4/1974 | Dowd, Jr. . | |
| 3,823,887 | 7/1974 | Gerstein . | |
| 3,826,361 | 7/1974 | Heckrodt | 206/409 |
| 3,830,143 | 8/1974 | Dowd, Jr. | 23/84 FF |
| 3,853,279 | 12/1974 | Gerstein . | |
| 3,856,226 | 12/1974 | Dowd, Jr. . | |
| 3,878,998 | 4/1975 | Lazzari . | |
| 4,013,236 | 3/1977 | Perrin . | |
| 4,113,195 | 9/1978 | Theunissen . | |
| 4,191,307 | 3/1980 | LeCaire, Jr. et al. | 221/45 |
| 4,274,573 | 6/1981 | Finkelstein | 225/106 |
| 4,289,262 | 9/1981 | Finkelstein | 225/106 |
| 4,297,403 | 10/1981 | Smith | 428/42 |
| 4,314,679 | 2/1982 | Paul et al. . | |
| 4,410,221 | 10/1983 | Vallis et al. . | |
| 4,467,974 | 8/1984 | Crim . | |
| 4,487,378 | 12/1984 | Kobayashi . | |
| 4,535,947 | 8/1985 | Hidle . | |
| 4,583,642 | 4/1986 | Blythe et al. | 206/390 |
| 4,614,312 | 9/1986 | Del Pino | 242/596.8 |
| 4,634,067 | 1/1987 | White | 242/599 |
| 4,659,028 | 4/1987 | Wren . | |
| 4,662,576 | 5/1987 | Paul | 242/596.4 |
| 4,667,890 | 5/1987 | Gietman, Jr. . | |
| 4,695,005 | 9/1987 | Gietman, Jr. . | |
| 4,757,952 | 7/1988 | Balzer . | |
| 4,760,970 | 8/1988 | Larsson et al. . | |
| 4,767,075 | 8/1988 | Peters et al. . | |
| 4,783,015 | 11/1988 | Shimizu . | |
| 4,807,825 | 2/1989 | Elsner et al. . | |
| 4,832,271 | 5/1989 | Geleziunas . | |
| 4,860,893 | 8/1989 | Kaufman | 200/390 |
| 5,065,924 | 11/1991 | Granger | 225/46 |
| 5,097,998 | 3/1992 | Shimasaki | 225/106 |
| 5,100,075 | 3/1992 | Morand . | |
| 5,161,793 | 11/1992 | Lotto et al. | 271/182 |
| 5,170,958 | 12/1992 | Brown . | |
| 5,197,727 | 3/1993 | Lotto et al. | 271/183 |
| 5,205,455 | 4/1993 | Moody | 225/106 |
| 5,215,211 | 6/1993 | Eberle | 221/1 |
| 5,219,126 | 6/1993 | Schutz . | |
| 5,271,137 | 12/1993 | Schutz | 29/400.1 |
| 5,271,575 | 12/1993 | Weinert . | |
| 5,281,386 | 1/1994 | Weinert | 265/512 |
| 5,310,129 | 5/1994 | Whittington et al. . | |
| 5,314,131 | 5/1994 | McCanless et al. . | |
| 5,352,319 | 10/1994 | Ishizu et al. | 156/446 |
| 5,362,013 | 11/1994 | Gietman, Jr. et al. | 242/521 |
| 5,366,175 | 11/1994 | Schutz | 242/597.6 |
| 5,370,336 | 12/1994 | Whittington | 242/560.2 |
| 5,370,339 | 12/1994 | Moody et al. | 242/597.6 |
| 5,385,318 | 1/1995 | Rizzuto | 242/597.8 |
| 5,386,950 | 2/1995 | Abt | 242/532 |
| 5,387,284 | 2/1995 | Moody | 118/220 |
| 5,390,875 | 2/1995 | Gietman, Jr. et al. | 242/521 |
| 5,402,960 | 4/1995 | Oliver et al. | 242/527.1 |
| 5,407,509 | 4/1995 | Ishizu et al. | 156/184 |
| 5,421,536 | 6/1995 | Hertel et al. | 242/526.1 |
| 5,439,187 | 8/1995 | Shimizu | 242/541.7 |
| 5,451,013 | 9/1995 | Schutz | 242/597.4 |
| 5,453,070 | 9/1995 | Moody | 493/288 |
| 5,467,935 | 11/1995 | Moody | 242/422.4 |
| 5,467,936 | 11/1995 | Moody | 242/525.7 |
| 5,474,436 | 12/1995 | Yamazaki | 425/103 |
| 5,480,060 | 1/1996 | Blythe | 221/63 |
| 5,495,997 | 3/1996 | Moody | 242/561 |
| 5,497,959 | 3/1996 | Johnson et al. | 242/542.2 |
| 5,505,402 | 4/1996 | Vigneau | 242/527.1 |
| 5,513,478 | 5/1996 | Abt | 53/118 |
| 5,518,200 | 5/1996 | Kaji et al. | 242/538.1 |
| 5,538,199 | 7/1996 | Biagiotti | 242/541.2 |
| 5,542,622 | 8/1996 | Biagiotti | 242/521 |
| 5,577,686 | 11/1996 | Moody | 242/597.4 |
| 5,603,467 | 2/1997 | Perini et al. | 242/521 |
| 5,609,269 | 3/1997 | Behnke et al. | 221/48 |
| 5,611,455 | 3/1997 | McCreary | 221/45 |
| 5,620,148 | 4/1997 | Mitchell | 242/160.4 |
| 5,620,544 | 4/1997 | Cram et al. | 156/184 |
| 5,636,812 | 6/1997 | Conner et al. | 242/559.2 |
| 5,639,046 | 6/1997 | Biagiotti | 242/541.2 |
| 5,642,810 | 7/1997 | Warner et al. | 206/389 |
| 5,660,349 | 8/1997 | Miller et al. | 242/526.1 |
| 5,669,576 | 9/1997 | Moody | 242/560.3 |
| 5,690,296 | 11/1997 | Biagiotti | 242/521 |
| 5,697,576 | 12/1997 | Bloch et al. | 242/596.7 |
| 5,722,608 | 3/1998 | Yamazaki | 242/160.1 |
| 5,725,176 | 3/1998 | Vigneau | 242/521 |
| 5,730,387 | 3/1998 | Yamazaki | 242/532.3 |
| 5,746,379 | 5/1998 | Shimizu | 242/160.1 |
| 5,797,559 | 8/1998 | Coffey | 242/527.6 |
| 5,839,680 | 11/1998 | Biagiotti | 242/160.1 |
| 5,848,762 | 12/1998 | Reinheimer et al. | 242/595 |
| 5,849,357 | 12/1998 | Andersson | 427/179 |
| 5,868,275 | 2/1999 | Moody | 221/33 |
| 5,875,985 | 3/1999 | Cohen et al. | 242/160 |
| 5,895,008 | 4/1999 | Sanders | 242/541.2 |
| 5,904,316 | 5/1999 | Dunning et al. | 242/595 |

ADAPTER AND DISPENSER FOR CORELESS ROLLS OF PRODUCTS

This application claims priority from presently copending U.S. Provisional Application No. 60/058,131 entitled "Adapter and Dispenser for Coreless Rolls of Products" and filed on Sep. 8, 1997.

FIELD OF THE INVENTION

This invention pertains to the field of commercial and consumer roll form products, absorbent paper products, which includes toilet tissue and paper towels. More specifically, this invention relates to an improved dispenser and method of dispensing a coreless roll of absorbent paper product.

BACKGROUND OF THE INVENTION

Commercial and consumer absorbent products such as shop towels, nonwoven fabrics, wipers, toilet tissue and paper towels are often distributed and dispensed in roll format. Most products in this format include a cylindrical core at the center of the roll. Typically, the product is wrapped about the core. Most roll format product dispensers require this core to function properly. The core is usually some type of cardboard tube, plastic tube, or solid spindle which is glued to the product so that the product does not separate from the core.

Product is normally loaded by mounting the roll on a spindle in a manner similar to the ubiquitous bathroom toilet roll dispenser. The spindle passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of products such as, for example, toilet tissue have appeared on the market, primarily in Europe. These coreless rolls are wound throughout the entire diameter of the roll. There are advantages and disadvantages associated with the coreless rolls. Coreless rolls are ecologically superior to cored rolls because they lack the central core made of plastic, cardboard or other material. In addition, more product can be provided in the space that would otherwise have been occupied by the core.

Cored rolls are more expensive to manufacture than coreless rolls because of the expense of making the cores and joining the cores to the product. In addition, coreless rolls have the advantage of being less subject to pilferage in commercial locations because of their inherent incompatibility with conventional dispensers.

On the other hand, coreless roll products have dispensing problems that are difficult to overcome. Coreless rolls do not fit into conventional core roll dispensers. Moreover, even though coreless rolls are less likely to be pilfered because they are incompatible with conventional dispensing systems, the lack of a core and spindle passing through the product that can be locked makes it relatively difficult to keep the coreless format product secure.

Conventional dispensers for coreless rolls typically include an enclosed surface that supports the roll as it turns, and an opening through which the product is passed. While functional, these dispensers have some undesirable characteristics, including an inability to control drag resistance to withdrawal of the product; the fact that the product actually touches the inside of the dispenser, which might be considered unsanitary by some consumers; and an inability to provide 180 degree product access to the consumer. Some dispensers for coreless rolls have pressure plates and pins that project into the side of the roll between the layers of product. It can be difficult to center the roll during loading of these dispenser without a centering device and the pressure plate and pins can easily be pried back to release the roll from the dispenser.

Accordingly, it is clear that a need exists for an adapter to convert conventional cored roll dispensers to handle coreless rolls. A need also exists for a coreless roll dispenser that can secure a coreless roll against pilferage. There is also a need for an adapter to convert conventional core roll dispensers to dispense coreless rolls of absorbent consumer and commercial paper products. There is a further need or a dispenser that can dispense coreless rolls of absorbent consumer and commercial paper products so they can be secured against pilferage.

SUMMARY OF THE INVENTION

The problems described above are addressed by the present invention which encompasses an adapter for converting a core roll product dispenser into a dispenser for a coreless roll product having a pair of depressions defined in the ends of the coreless roll.

The adapter includes: (1) a housing defining a central cavity and an opening at an end of the central cavity; (2) a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; (3) resilient means in communication with the plunger, the resilient means being configured to apply a force against the plunger so the plunger is adapted to retract into the central cavity when a greater opposing force is applied against its distal end during loading and extend when the greater opposing force is removed; and (4) attachment means for securing the adapter to a core roll product dispenser.

According to the invention, the housing of the adapter may further includes a mounting base so the adapter may be more easily attached to a core roll product dispenser.

The resilient means in communication with the plunger may be a spring, clip, sponge, elastomeric material or the like which can be compressed, wound or drawn so the plunger may be retracted and which exerts a force while compressed, wound or drawn so the plunger can be extended.

The base of the plunger may be configured to define an opening to a cavity at the interior of the plunger. The resilient means may protrude into the cavity at the interior of the plunger. For example, if the resilient means is a spring, the spring may protrude into the base of the plunger.

In an embodiment of the invention, the opening at the end of the central cavity may be circular. The opening may be triangular, square, diamond, semi-circular, "X", "Y" or "T"-shaped or the like. Desirably, the opening at the end of the central cavity will match the cross-section of the plunger. Accordingly, the plunger may have cross-section that is circular, triangular, square, diamond, semi-circular, "X", "Y" or "T"-shaped or the like.

It is desirable that the plunger has a cross-section width of at least 1 centimeter. If the plunger has a circular cross-section, it is desirable that the diameter be at least 1 centimeter. The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger may extend from the opening at the end of the housing for a distance that is greater than the width of the plunger. For example, if the plunger has a cross-section width of about 1 centimeter, it is desirable for the distal end of the plunger to extend more than about 1 centimeter from the opening at the end of the housing. As a further example, the distal end of the plunger may extend for 1.25 centimeters, 1.5 centimeters, 1.75 centimeters, 2.0 centimeters, or 2.25 centimeters or more. A greater extension of the plunger helps provides greater penetration into the depressions defined at the ends of the coreless roll product and helps to prevent pilferage of the coreless roll product from the dispenser.

A retracting means in communication with the retractable plunger may be used for retracting the plunger against the force applied by the resilient means. The retracting means may be a knob, a lever and cam mechanism, a pull or the like.

In an embodiment of the invention, a locking means for holding the retractable plunger in an extended position may be included in the adapter. The locking means may be a cam, lever, ratchet, cotter pin or the like. The locking means may be activated by a key or pin.

The retractable plunger may further include a retaining means for preventing the retractable plunger from passing entirely through the opening at an end of the central cavity. This retaining means may be, for example, a flange, a lip, a pin, a wedge or similar structure.

The present invention also encompasses a dispenser for a coreless roll product having a pair of depressions defined in the ends of the coreless roll. The dispenser includes: a frame; mounting means for permitting the frame to be mounted to a stationary surface such as a wall; and a coreless roll securing means for securing a coreless roll product for rotation within the frame. The coreless roll securing means contains at least one element including: (1) a housing defining a central cavity and an opening at an end of the central cavity; (2) a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; (3) resilient means in communication with the plunger, the resilient means being configured to apply a force against the plunger so the plunger is adapted to retract into the central cavity when a greater opposing force is applied against its distal end during loading and extend when the greater opposing force is removed; and (4) attachment means for securing the adapter to a core roll product dispenser.

The mounting means for the dispenser may be, for example, an opening defined in the frame for a securing member such as a bolt. Other mounting means, such as clips, pins, screws, latches and the like may also be used.

In an embodiment of the present invention, the coreless roll securing means may further include a pair of opposed arms that are connected to the frame. In such an embodiment, there is mounted to an inner side of each arm an element including: (1) a housing defining a central cavity and an opening at an end of the central cavity; (2) a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; (3) resilient means in communication with the plunger, the resilient means being configured to apply a force against the plunger so the plunger is adapted to retract into the central cavity when a greater opposing force is applied against its distal end during loading and extend when the greater opposing force is removed; and (4) attachment means for securing the adapter to a core roll product dispenser, whereby radial displacement of the coreless roll with respect to said frame is prevented during use.

The dispenser may further include biasing means for resiliently biasing at least one of the opposed arms toward the coreless roll. The biasing means may be in the form of at least one of the opposed arms being constructed out of a resilient material, so that arm (or arms) is configured so as to be slightly displaced when a coreless roll is secured within the dispenser.

The coreless roll securing means of the dispenser is composed of at least one of the elements described above. These elements include resilient means in communication with the plunger. The resilient means may be a spring, clip, sponge, elastomeric material or the like which can be compressed, wound or drawn so the plunger may be retracted and which exerts a force while compressed, wound or drawn so the plunger can be extended.

The base of the plunger may be configured to define an opening to a cavity at the interior of the plunger. The resilient means may protrude into the cavity at the interior of the plunger. For example, if the resilient means is a spring, the spring may protrude into the base of the plunger.

The opening at the end of the central cavity may be circular. The opening may be triangular, square, diamond, semi-circular, "X", "Y" or "T"-shaped or the like. Desirably, the opening at the end of the central cavity will match the cross-section of the plunger. Accordingly, the plunger may have cross-section that is circular, triangular, square, diamond, semi-circular, "X", "Y" or "T"-shaped or the like.

It is desirable that the plunger has a cross-section width of at least 1 centimeter. If the plunger has a circular cross-section, it is desirable that the diameter be at least 1 centimeter. The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger may extend from the opening at the end of the housing for a distance that is greater than the width of the plunger. For example, if the plunger has a cross-section width of about 1 centimeter, it is desirable for the distal end of the plunger to extend more than about 1 centimeter from the opening at the end of the housing. As a further example, the distal end of the plunger may extend for 1.25 centimeters, 1.5 centimeters, 1.75 centimeters, 2.0 centimeters, or 2.25 centimeters or more. A greater extension of the plunger helps provides greater penetration into the depressions defined at the ends of the coreless roll product and helps to prevent pilferage of the coreless roll product from the dispenser.

A retracting means in communication with the retractable plunger may be used for retracting the plunger against the force applied by the resilient means. The retracting means may be a knob, a lever and cam mechanism, a pull or the like.

In an embodiment of the invention, a locking means for holding the retractable plunger in an extended position may be included in the adapter. The locking means may be a cam, lever, ratchet, cotter pin or the like. The locking means may be activated by a key or pin.

The retractable plunger may further include a retaining means for preventing the retractable plunger from passing entirely through the opening at an end of the central cavity. This retaining means may be, for example, a flange, a lip, a pin, a wedge or similar structure.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 2A is an illustration similar to FIG. 2 of an alternative exemplary adapter showing an exemplary knob and lock.

FIG. 3A is an illustration similar to FIG. 3 of an alternative exemplary adapter showing an exemplary knob and lock.

DETAILED DESCRIPTION

Figure 1:
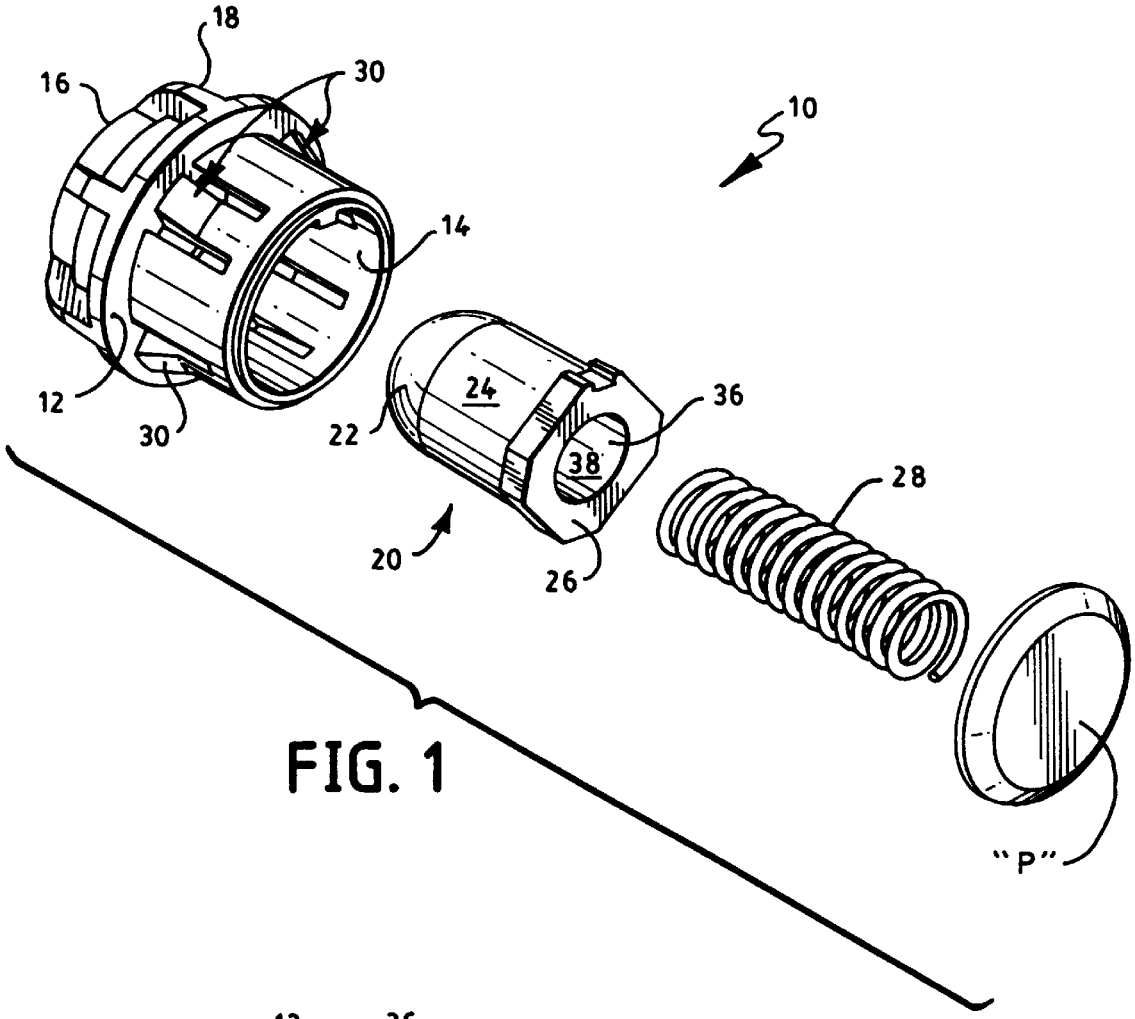
FIG. 1 is an illustration of an exemplary adapter for converting a core roll product dispenser to a coreless roll product dispenser.

Referring now to the drawings, wherein like reference numerals designate corresponding structure throughout the views, and referring in particular to FIG. 1, there is shown (not necessarily to scale) an illustration of an exemplary adapter 10 for converting a core roll product dispenser into a dispenser for a coreless roll product having a pair of depressions defined in the ends of the coreless roll.

The adapter includes a housing 12 defining a central cavity 14 and an opening 16 at an end 18 of the central cavity 14. The adapter contains a retractable plunger 20 having a distal end 22, a central shaft 24, and a base 26. The adapter also includes a resilient means 28 in communication with the plunger 20. An attachment means 30 is also included on the adapter for securing the adapter to a core roll product dispenser. In some embodiments of the invention, a backing plate "P" may be attached to the housing 12 to keep the resilient means 28 contained within the adapter 10 and to allow for convenient placement of the plunger 20 into the central cavity 14 of the housing 12.

Figure 2:
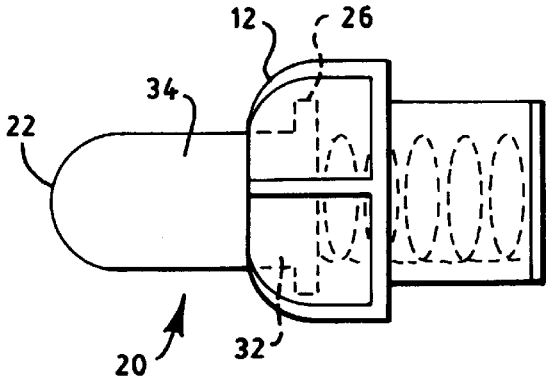
FIG. 2 is a cross sectional view depicting the adapter shown in FIG. 1.

Referring now to FIG. 2, it can be seen that the retractable plunger 20 is configured so the base 26 and a first portion 32 of the central shaft 24 is retained in the housing 12 and the distal end 22 and a second portion 34 of the central shaft 24 extends through the opening 16 at an end of the central cavity 14 so the plunger is adapted to penetrate a depression defined at an end of a coreless roll product. The plunger may be configured so it essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

The retractable plunger may further include a retaining means for preventing the retractable plunger from passing entirely through the opening at an end of the central cavity. Generally speaking, the base 26 of the plunger may serve as the retaining means. As can be seen in FIG. 2, the width of the base 26 is greater than the width of the opening 16 at the end 18 of the central cavity 14. This difference in physical size prevents the plunger from passing entirely through the opening. However, it is contemplated that may other types of retaining means may be used. Examples may include, but are not limited to, flanges, lips, pins, collars, rings, wedges, clips, posts, chains, leads, or similar structures or devices.

Figure 3:
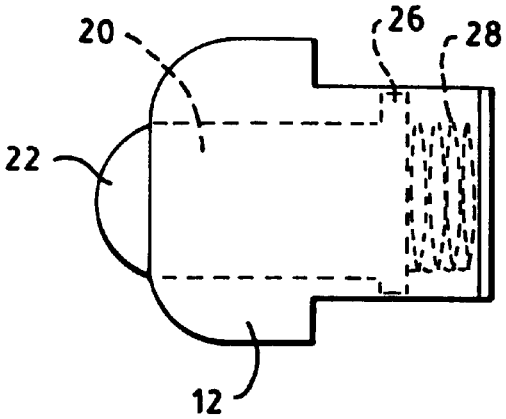
FIG. 3 is a cross sectional view depicting the adapter shown in FIG. 1 in a retracted position.

Referring now to FIG. 3, the resilient means 28 is configured to provide or apply a force against the plunger 20 so the plunger 20 is adapted to retract into the central cavity 14 when a greater opposing force is applied against its distal end 22 during loading and extend when the greater opposing force is removed. The resilient means in communication with the plunger may be a spring, clip, sponge, elastomeric material or the like which can be compressed, wound or drawn so the plunger may be retracted and which exerts a force while compressed, wound or drawn so the plunger can be extended. The force provided or applied by the resilient means serves two purposes.

First, the resilient means allows the plungers to retract during the loading process. In some dispenser configurations the distance between the two adapters is fixed so it is just slightly larger than the width of the roll. The plungers must be able to retract in order to load the roll.

Second, the force provided or applied by the resilient means is used to retain the roll when the diameter of the roll is very small. The force must be balanced so it retains a nearly depleted roll but does not apply too much pressure to prevent the roll from rotating on the fixed plunger.

Referring back to FIG. 1, the base of the plunger 20 may be configured to define an opening 36 to a cavity 38 at the interior of the plunger 20. The resilient means 28 may protrude into the cavity 38 at the interior of the plunger. For example, if the resilient means is a spring, the spring may protrude into the base of the plunger.

Figure 4:
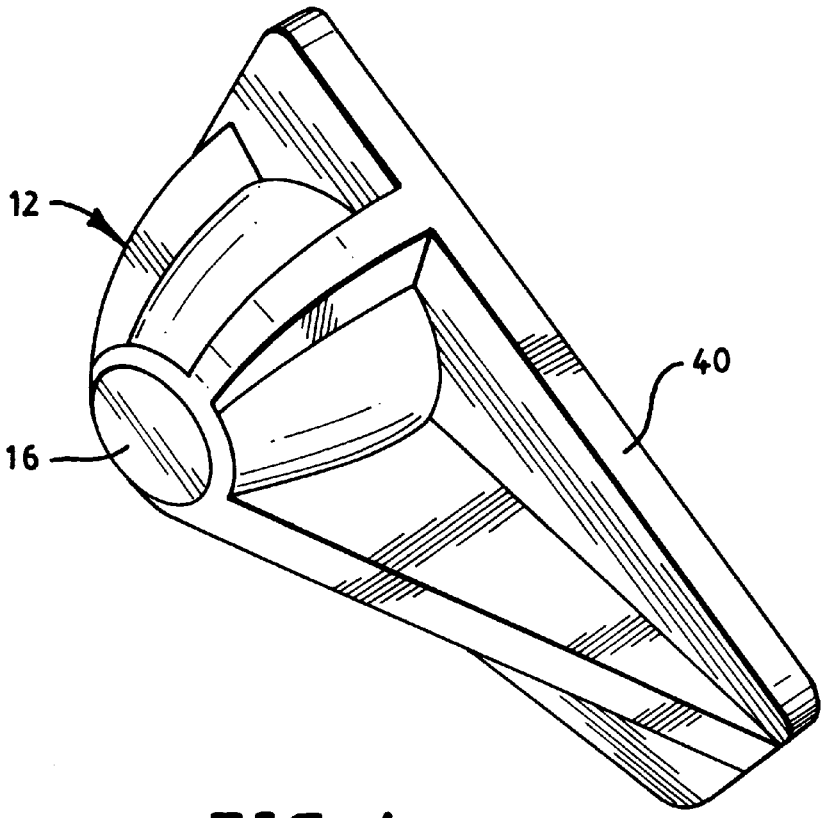
FIG. 4 is an illustration of a detail of an exemplary adapter.

Referring now to FIG. 4, the housing 12 of the adapter 10 may further include a mounting base 40 so the adapter may be more easily attached to a core roll product dispenser. The mounting base 40 may be configured to provide a large footprint that provides more stability and/or surface area. A large surface area may be advantageous if adhesives are used (alone or in combination with other attachment means) to join the adapter to a core roll product dispenser.

Figure 5:
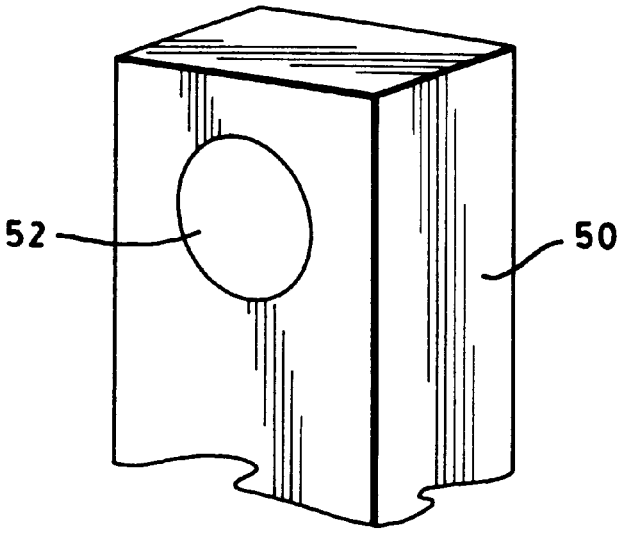
FIG. 5 is an illustration of a dispensing arm from a conventional core roll product dispenser.

FIG. 5, is an illustration of a portion of an arm typically found on conventional core roll format product dispensers. The illustration shows a dispensing arm 50 defining an opening 52. This opening 52 is normally configured to receive a spindle (not shown) that passes through the center of a core roll product as in a conventional bathroom tissue dispenser. Alternatively and/or additionally, the opening 52 may be adapted to receive a spindle on which the core roll product was wound or otherwise provided with. Conventional core roll product dispensers typically have two of these dispensing arms (with openings 52) mounted in a frame. Some conventional dispensers may have sides instead of arms and may have openings configured in the sides. In either case, the arms or sides and corresponding openings are separated by a distance that is slightly greater than the width of the roll of the core roll product to be dispensed.

Figure 6:
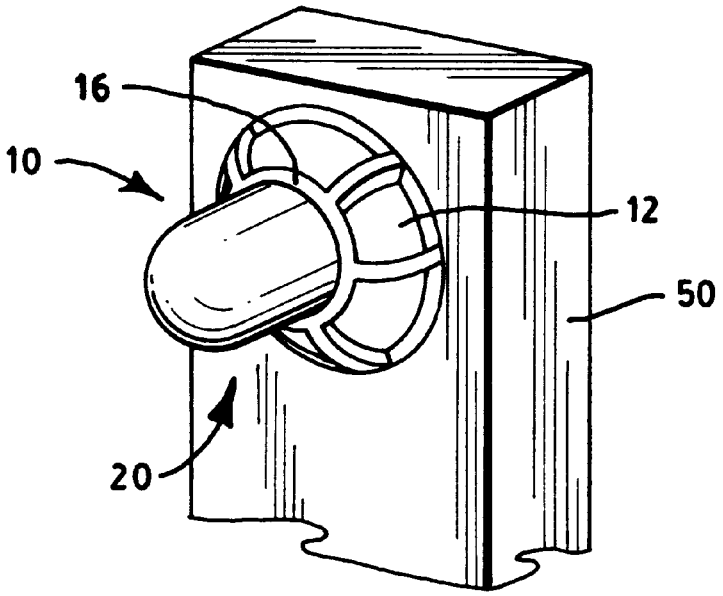
FIG. 6 is an illustration of an exemplary adapter fitted in a dispensing arm of a conventional core roll product dispenser.

FIG. 6 is an illustration of an exemplary adapter mounted on the conventional core roll product dispensing arm 50 shown in FIG. 5. The adapter 10 fits into the opening 52 shown in FIG. 5. In this illustration, a portion of the adapter housing 12 is shown extending from the arm 50. A plunger 20 is shown protruding from an opening 16 at an end the housing 12. Mounting adapters 10 on each arm of a conventional core roll product dispenser quickly and easily converts a conventional dispenser to a coreless roll product dispenser. Retractable plungers 20 protruding from each arm are adapted to fit into depressions defined at each end of the coreless roll product.

Figure 7:
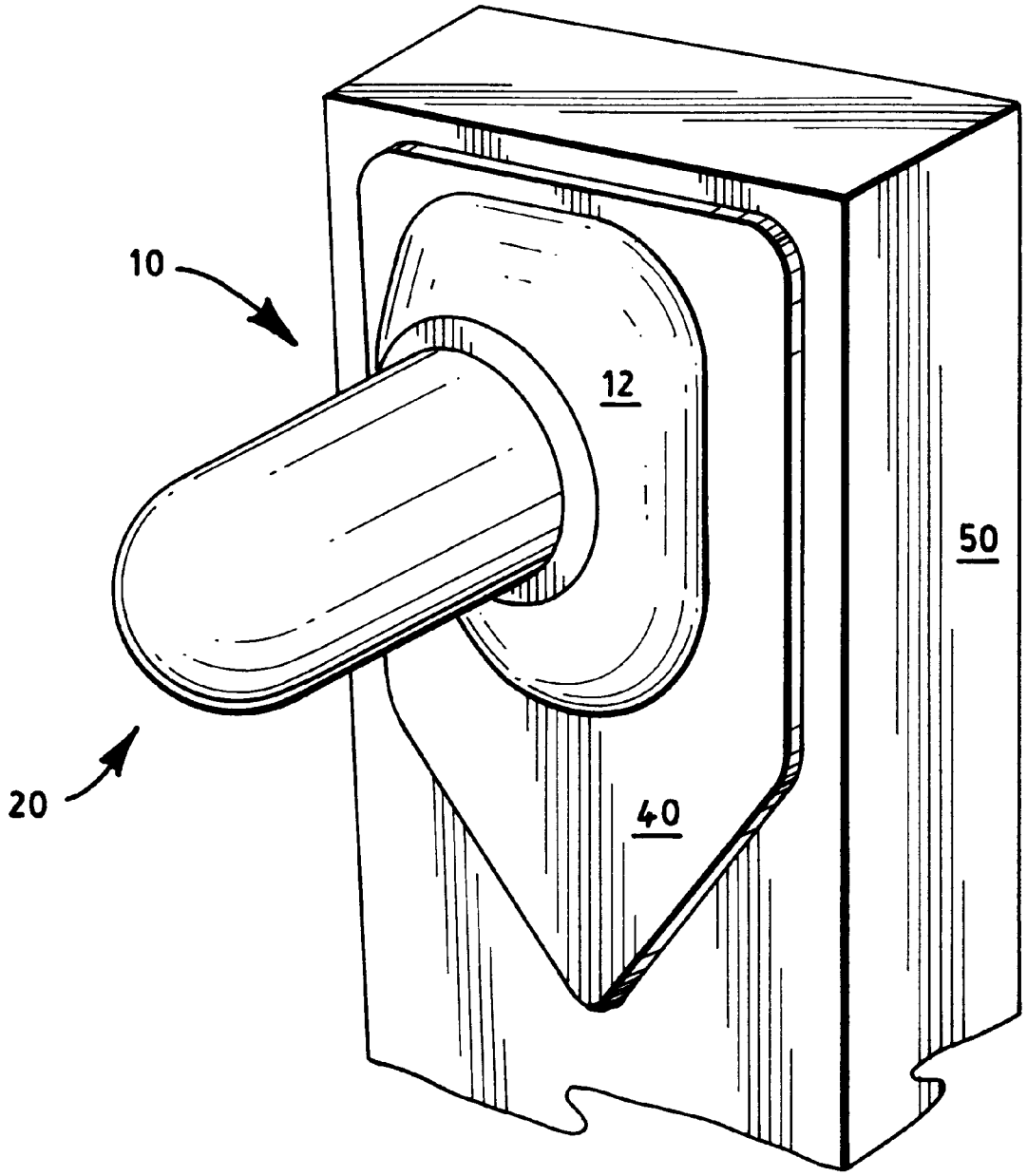
FIG. 7 is an illustration of a feature of an exemplary adapter.

FIG. 7 is an illustration of another exemplary adapter mounted on the conventional core roll product dispensing arm 50 shown in FIG. 5. This adapter is configured with a mounting base 40 attached to the housing 12 generally as shown in FIG. 4. The large mounting base 40 stabilizes the adapter 10 when forces are applied during loading and/or dispensing. The large mounting base 40 also provides a greater area for adhesive attachment if such attachment means are used.

In an embodiment of the invention, the opening 16 at the end 18 of the central cavity 14 may be circular. The opening 16 may also be any suitable shape or cross-section. For example, the opening 16 may be triangular, square, diamond, semi-circular, "X", "Y" or "T"-shaped or the like. Desirably, the opening at the end of the central cavity will match the cross-section of the plunger. Accordingly, the plunger may have a cross-section that is circular, triangular, square, diamond, semi-circular, "X", "Y" or "T"-shaped or the like.

Generally speaking, it is desirable for the plunger to have a cross-section width that is slightly greater than the width of the depression in the end of the coreless roll product. This configuration helps secure the roll when loaded, prevents overspin of the roll during dispensing, and assists in holding the roll as the roll is depleted. For example, if the depressions defined in both ends of the coreless roll have a diameter of slightly less than 1 centimeter (e.g., ~0.9 cm) the plunger desirably will have a diameter or width of about 1 centimeter or slightly greater than 1 centimeter.

In an embodiment of the invention, it is desirable that the plunger has a cross-section width of at least 1 centimeter (approximately ½ inch). If the plunger has a circular cross-section, it is desirable that the diameter be at least 1 centimeter. The distal end of the plunger may have a radius of curvature and desirably defines a hemisphere. The rounded tip serves as a centering device for loading the roll and eases loading by providing a leading edge. The straight sides of the plunger help keep the roll from wobbling during dispensing, help the roll rotate freely and avoid damage to the roll during dispensing. Of course, other geometries are contemplated for the shape of the distal end of the plunger. It is also contemplated that the plunger may have a narrow width or a variable width.

Desirably, the distal end of the plunger extends from the opening at the end of the housing for a distance that is greater than the width of the plunger. For example, if the plunger has a cross-section width of about 1 centimeter, it is desirable for the distal end of the plunger to extend more than about 1 centimeter from the opening at the end of the housing. As a further example, the distal end of the plunger may extend for 1.25 centimeters, 1.5 centimeters, 1.75 centimeters, 2.0 centimeters, or 2.25 centimeters or more. A greater extension of the plunger helps provides greater penetration into the depressions defined at the ends of the coreless roll product. Good penetration of the plunger into the coreless roll and the straight, smooth sides of the plunger help to prevent pilferage of the coreless roll product from the dispenser by making it difficult to get a grip on the plunger to push it back into a retracted position and unload the roll. Thus the product may be loaded on the dispenser until the roll is entirely depleted.

A retracting means in communication with the retractable plunger may be used for retracting the plunger against the force applied by the resilient means. The retracting means may be a knob, a lever and cam mechanism, a pull or the like. Such a retracting means in the form of a knob 300 is shown in FIGS. 2A and 3A. The same reference numbers as in FIGS. 2 and 3 shows other parts of the device in FIGS. 2A and 3A. This feature is optional and may be located opposite the plunger (i.e., on the opposite side of the housing as the plunger). In other embodiments of the invention, a locking means for holding the retractable plunger in an extended position may be included in the adapter. Such a locking means in the form of a cam 310 is shown in FIGS. 2A and 3A. The same reference numbers as in FIGS. 2 and 3 shows other parts of the device in FIGS. 2A and 3A. The locking means may be a cam, lever, ratchet, cotter pin or the like. The locking means may be activated by a key or pin. Such a locking means would be desirable for adapters used in environments where pilferage of product may be encountered. The locking means on the plunger would discourage unloading of the coreless roll by make it even more difficult to push back or retract the plungers out of the depressions defined in the ends of the coreless roll product.

Figure 8:
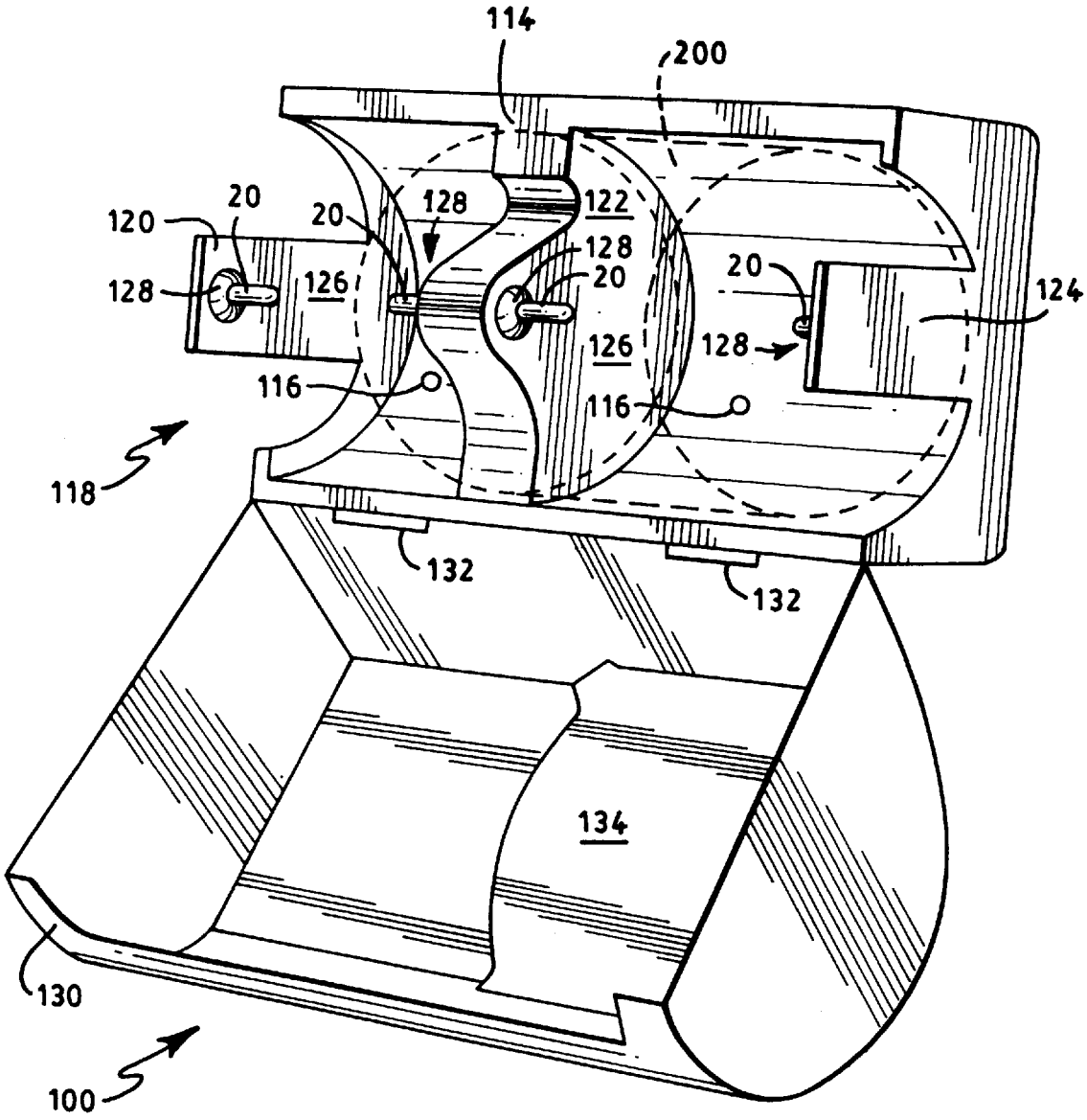
FIG. 8 is an illustration of an exemplary coreless roll product dispenser.
Figure 9:
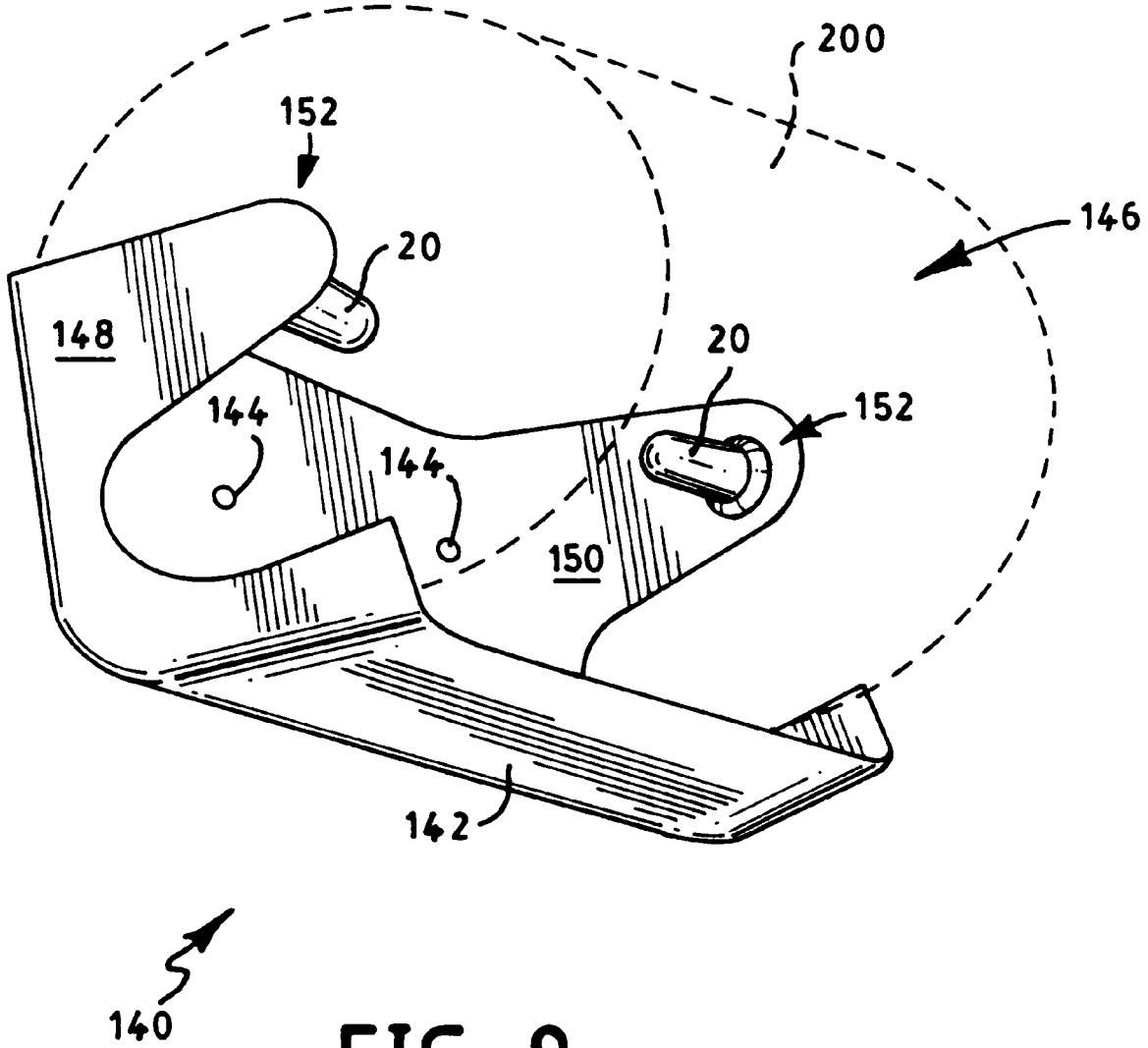
FIG. 9 is an illustration of an exemplary coreless roll product dispenser.
Figure 10:
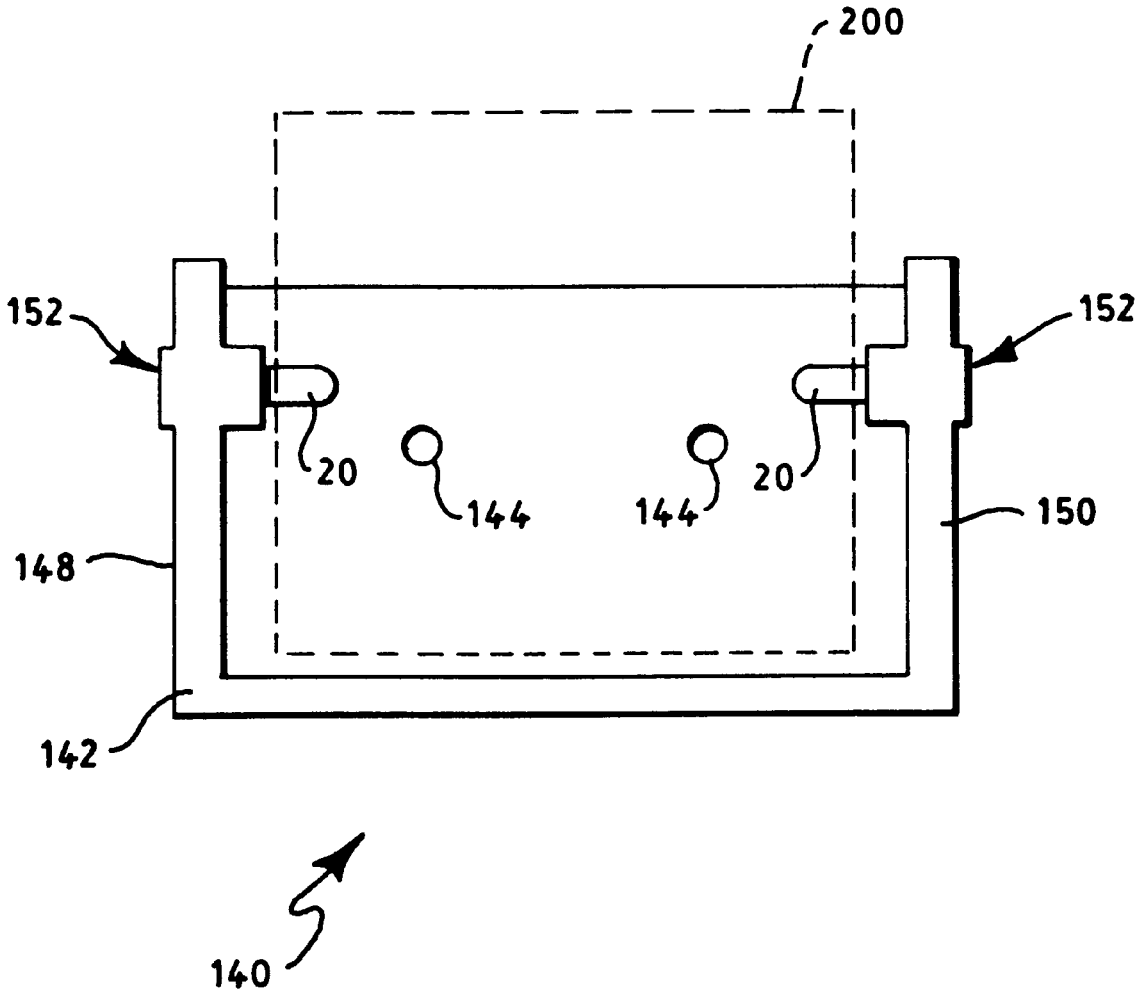
FIG. 10 is an illustration of an exemplary coreless roll product dispenser.

The present invention also encompasses a dispenser for dispensing a coreless roll product having a pair of depressions defined in the ends of the coreless roll. Many different types of products may be produced in a coreless roll format. For example, commercial and consumer absorbent products such as shop towels, nonwoven fabrics, wipers, bathroom tissue and paper towels are often distributed and dispensed in roll format. Referring now to FIGS. 8–10 and in particular to FIG. 8, there is shown a dispenser 100 for dispensing coreless roll products 200 (shown in broken lines) having a pair of depressions defined in the ends of the coreless roll.

The dispenser 100 includes a frame 114 that has mounting holes 116 defined therein for permitting the frame to be mounted to a stationary surface, such as a wall. The dispenser 100 further includes a coreless roll securing mechanism 118 for securing a coreless roll 200 of product (e.g., bathroom tissue) for rotation within the frame 114. In the embodiment shown in FIG. 8, the coreless roll securing mechanism 118 includes a first arm 120, a second, central arm 122 and a third arm 124.

The dispenser 100 depicted in FIG. 8 is designed to accommodate two rolls of coreless roll product (e.g., bathroom tissue), much in the manner of many conventional dispensers that are available for commercial application. Desirably, the outer arms 120, 124 are constructed so they are rigid and will not move. However, in an embodiment of the invention, the outer arms 120, 124 may be made of a resilient material, such as spring steel, and are configured so they will be slightly displaced when a coreless roll is secured between the central arm 122 and the respective outer arms 120, 124. In this way, the outer arms 120, 124 will bias the respective coreless roll 200 toward the central arm 122.

One important advantage of the invention is that the coreless roll securing mechanism 118 is designed to prevent radial displacement of the coreless rolls 200 with respect to the frame 114 of the dispenser 100 during use, so that a coreless roll can be dispensed without fear of radial displacement during use as confidently as a conventional cored roll of absorbent paper product can be.

Desirably, this is achieved by providing elements 128 on inner surfaces 126 of the respective arms 120, 122, 124 of the securing mechanism 118. Each element 128 is configured essentially in accordance with the adapter construction shown in FIG. 1. As an example and with reference to FIG. 1, each element may include a housing 12 defining a central cavity 14 and an opening 16 at an end 18 of the central cavity 14. The housing may be an integral part of the respective arms 120, 122, and 124 (shown in FIG. 8) or may be a discrete unit that is attached to each of the arms. Each element includes a retractable plunger 20 having a distal end 22, a central shaft 24, and a base 26. Each element also includes a resilient means 28 in communication with the plunger 20.

The elements 128 of the securing mechanism 118 may optionally include an attachment means 30 as shown for the adapter construction of FIG. 1. The attachment means may be used if the housing is constructed as a discrete unit and is not integral with the arms of the securing mechanism (i.e., if the housing is not molded, welded, constructed, formed, etc. as part of the arms of the securing mechanism). Other features of the elements 128 of the securing mechanism 118 are essentially in accordance with the adapter construction as shown in FIGS. 2–4.

For example, the elements 128 may be constructed to include a backing plate be attached to the housing to keep the resilient means contained within the element and to allow for convenient placement of the plunger into the central cavity of the housing. Generally speaking, the retractable plunger is configured so the base and a first portion of the central shaft is retained in the housing and the distal end and a second portion of the central shaft extends through the opening at an end of the central cavity so the plunger is adapted to penetrate a depression defined at an end of a coreless roll product. The plunger may be configured so it is essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

The retractable plunger may further include a retaining means for preventing the retractable plunger from passing entirely through the opening at an end of the central cavity. Generally speaking, the base of the plunger may serve as the retaining means. This may be accomplished by constructing the plunger so the width of its base is greater than the width of the opening at the end of the central cavity. This difference in physical size prevents the plunger from passing entirely through the opening. However, it is contemplated that may other types of retaining means may be used. Examples may include, but are not limited to, flanges, lips, pins, collars, rings, wedges, clips, posts, chains, leads, or similar structures or devices.

The resilient means is configured to provide or apply a force against the plunger so the plunger is adapted to retract into the central cavity when a greater opposing force is applied against its distal end during loading and extend when the greater opposing force is removed. The resilient means in communication with the plunger may be a spring, clip, sponge, elastomeric material or the like which can be compressed, wound or drawn so the plunger may be retracted and which exerts a force while compressed, wound or drawn so the plunger can be extended.

In an embodiment, the base of the plunger may be configured to define an opening to a cavity at the interior of the plunger. The resilient means may protrude into the cavity at the interior of the plunger. For example, if the resilient means is a spring, the spring may protrude into the base of the plunger.

Referring to FIG. 8, a number of retractable plungers 20 extend inwardly from the respective elements 128 toward where the coreless roll 200 of product will be held during operation. These retractable plungers 30 are specifically designed to penetrate the depressions defined at each end of the coreless roll to secure the coreless roll against pilferage and to prevent radial displacement of the coreless roll during use.

In embodiments of the invention where the arms 120 and 124 are constructed out of resilient material, it will be appreciated that the biasing provided by the resiliency of arms will aid the plungers 20 in penetrating depressions defined at the ends of the coreless roll and enhance the securement of the coreless rolls within the dispenser 100 during use.

Desirably, the dispenser 100 includes a cover 130 that is hinged to the frame 114 by hinges 132. A sliding window 134 may be provided in the cover 130 to selectively expose the roll 200 of coreless roll product that is being dispensed at a particular point in time, and to deny access to the other roll or vacated mounting location. The cover 130, hinges 132, and the sliding window 134 are conventional.

Referring now to FIGS. 9 and 10, there is shown another embodiment of the present invention. FIGS. 9 and 10 illustrate an exemplary dispenser 140 for dispensing a coreless roll 200 of product. The dispenser 140 includes a frame 142, which is embodied as a relatively simplified shield about the space where the coreless roll 200 will be positioned during use. The frame 142 has mounting holes 144 defined in a rear portion thereof for mounting the dispenser 140 to a stationary surface, such as a wall. The dispenser 140 further includes a coreless roll-securing mechanism 146 that is embodied as a first arm 148 and a second arm 150. A pair of elements 152 mounted to the respective arms 148, 150 and have plungers 20 thereon that are constructed and arranged to penetrate into the depressions defined at the ends of the coreless roll in the manner described above. It is contemplated that the elements 152 may be molded, formed, cast, welded or otherwise constructed as an integral part of the arms 148 and 152 instead of being discrete units mounted on the arms.

It is contemplated that only one of the elements needs to be configured so that its plunger is retractable to achieve satisfactory operation of the present invention (e.g., to load of the dispenser). Desirably, both or all elements will be configured so the plungers will be retractable.

The present invention also encompasses a method of installing a coreless roll having a pair of depressions defined at opposite ends of the roll in a dispenser. The method includes the steps of: (a) applying a force to at least one retractable plunger to retract the plunger; (b) orienting a coreless roll with a pair of depressions at opposite ends of the roll so at least one depression is adjacent at least one plunger; (c) securing the coreless roll to the dispenser by penetrating at least one depression in the coreless roll with at least one plunger. The method of the present invention encompasses embodiments where step (b) involves orienting the coreless roll so both depressions are adjacent plungers. The method of the present invention further encompasses embodiments where step (c) involves penetrating both depressions with plungers.

The method of the present invention may further involve resiliently biasing the plungers into the coreless roll during operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An adapter for converting a core roll product dispenser into a dispenser for a coreless roll product having a pair of depressions defined in the ends of the coreless roll, the adapter comprising:

a housing defining a central cavity and an opening at an end of the central cavity;

a retractable plunger having a distal end, a central shaft, and a base, the retractable plunger being configured so the base and a first portion of the central shaft are retained in the housing and the distal end and a second portion of the central shaft extend through the opening at an end of the central cavity so the distal end of the plunger extends from the opening at the end of the housing for a distance that is greater than the width of the plunger and is adapted to penetrate a depression defined at an end of a coreless roll product;

resilient means in communication with the plunger, the resilient means being configured to apply a force against the plunger so the plunger is adapted to retract into the central cavity when a greater opposing force is applied against its distal end during loading and extend when the greater opposing force is removed; and attachment means for securing the adapter to a core roll product dispenser.

2. The adapter of claim 1, further comprising a retracting means in communication with the retractable plunger for retracting the plunger against the force applied by the resilient means.

3. The adapter of claim 2, wherein the retracting means is a knob.

4. The adapter of claim 1, further comprising a locking means for holding the retractable plunger in an extended position.

5. The adapter of claim 1, wherein the housing further includes a mounting base.

6. The adapter of claim 1, wherein the base of the plunger defines an opening to a cavity at the interior of the plunger.

7. The adapter of claim 1, wherein the resilient means in communication with the plunger is a spring.

8. The adapter of claim 7, wherein the resilient means protrudes into the cavity at the interior of the plunger.

9. The adapter of claim 1, wherein the opening at the end of the central cavity is circular.

10. The adapter of claim 1, wherein the plunger has a circular cross-section.

11. The adapter of claim 1, wherein the plunger has a cross-section diameter of at least 1 centimeter.

12. The adapter of claim 1, wherein the distal end of the plunger defines a hemisphere.

13. The adapter of claim 1, further comprising a locking means for holding the retractable plunger in an extended position.

14. The adapter of claim 1, wherein the retractable plunger further includes a retaining means for preventing the retractable plunger from passing entirely through the opening at an end of the central cavity.

15. The adapter of claim 14, wherein the retaining means is a flange.

16. A dispenser for a coreless roll product having a pair of depressions defined in the ends of the coreless roll, the dispenser comprising:

a frame;

mounting means for permitting the frame to be mounted to a stationary surface; and a coreless roll securing means for securing a coreless roll product for rotation within the frame, the coreless roll securing means comprising at least one element including;

a housing defining a central cavity and an opening at an end of the central cavity;

a retractable plunger having a distal end, a central shaft, and a base, the retractable plunger being configured so the base and a first portion of the central shaft are retained in the housing and the distal end and a second portion of the central shaft extend through the opening at an end of the central cavity so the distal end of the plunger extends from the opening at the end of the housing for a distance that is greater than the width of the plunger and is adapted to penetrate a depression defined at an end of a coreless roll product; and resilient means in communication with the plunger, the resilient means being configured to apply a force against the plunger so the plunger is adapted to retract into the central cavity when a greater opposing force is applied against its distal end during loading and extend when the greater opposing force is removed, whereby radial displacement of the coreless roll with respect to said frame is prevented during use.

17. The dispenser of claim 16, wherein the coreless roll securing means further comprises a retracting means in communication with the retractable plunger for retracting the plunger against the force applied by the resilient means.

18. The dispenser of claim 17, wherein the retracting means is a knob.

19. The dispenser of claim 16, further comprising a locking means for holding the retractable plunger in an extended position.

20. The dispenser of claim 16, wherein said mounting means comprises an opening defined in said frame for a securing member.

21. The dispenser of claim 16, wherein the coreless roll securing means further comprises a pair of opposed arms that are connected to the frame, and mounted to an inner side of each arm is an element including:

a housing defining a central cavity and an opening at an end of the central cavity;

a retractable plunger having a distal end, a central shaft, and a base, the retractable plunger being configured so the base and a first portion of the central shaft are retained in the housing and the distal end and a second portion of the central shaft extend through the opening at an end of the central cavity so the plunger is adapted to penetrate a depression defined at an end of a coreless roll product; and resilient means in communication with the plunger, the resilient means being configured to apply a force against the plunger so the plunger is adapted to retract into the central cavity when a greater opposing force is applied against its distal end during loading and extend when the greater opposing force is removed, whereby radial displacement of the coreless roll with respect to said frame is prevented during use.

22. The dispenser of claim 21, further comprising biasing means for resiliently biasing at least one of the opposed arms toward said coreless roll.

23. The dispenser of claim 22, wherein said biasing means comprises at least one of said opposed arms being constructed out of a resilient material, and said at least one arm is configured so as to be slightly displaced when a coreless roll is secured within the dispenser.

24. The dispenser of claim 16, wherein the base of the plunger defines an opening to a cavity at the interior of the plunger.

25. The dispenser of claim 24, wherein the resilient means protrudes into the cavity at the interior of the plunger.

26. The dispenser of claim 16, wherein the resilient means in communication with the plunger is a spring.

27. The dispenser of claim 16, wherein the opening at the end of the central cavity is circular.

28. The dispenser of claim 16, wherein the plunger has a circular cross-section.

29. The dispenser of claim 16, wherein the plunger has a cross-section diameter of at least 1 centimeter.

30. The dispenser of claim 16, wherein the distal end of the plunger defines a hemisphere.

31. The dispenser of claim 16, further comprising a locking means for holding the retractable plunger in an extended position.

32. The dispenser of claim 16, wherein the retractable plunger further includes a retaining means for preventing the retractable plunger from passing entirely through the opening at an end of the central cavity.

33. The dispenser of claim 32, wherein the retaining means is a flange.

* * * * *